US006081928A

United States Patent [19]

Bourne

[11] Patent Number: 6,081,928

[45] Date of Patent: Jul. 4, 2000

[54] ELASTOMERIC GLOVE WITH ENHANCED GRIP STRENGTH

[75] Inventor: George Bourne, Libertyville, Ill.

[73] Assignee: Allegiance Corporation, McGaw Park, Ill.

[21] Appl. No.: 09/167,938

[22] Filed: Oct. 6, 1998

[51] Int. Cl.[7] ..... A41D 19/00

[52] U.S. Cl. ..... 2/161.8; 2/161.6; 2/161.7; 2/163; 2/167

[58] Field of Search ..... 2/159, 160, 161.3, 2/161.6, 161.7, 161.8, 166, 163, 168, 167; 473/59

[56] References Cited

U.S. PATENT DOCUMENTS

| | | | |
|---|---|---|---|
| D. 202,329 | 9/1965 | Swistel | D3/11 |
| 1,161,719 | 11/1915 | Norton . | |
| 1,885,572 | 11/1932 | Wood | 601/137 |
| 1,911,500 | 5/1933 | Gowdy et al. . | |
| 2,049,323 | 7/1936 | Schmidt | 68/8 |
| 2,187,430 | 1/1940 | Olmstead et al. | 2/168 |
| 2,293,928 | 8/1942 | Beal | 117/163 |
| 2,913,729 | 11/1959 | Wisenburg | 2/167 |
| 4,084,265 | 4/1978 | Anfelt | 2/163 |
| 4,329,312 | 5/1982 | Ganz | 264/306 |
| 5,459,879 | 10/1995 | Fuchs | 2/161.7 |
| 5,603,118 | 2/1997 | Solomon | 2/20 |
| 5,625,900 | 5/1997 | Hayes | 2/161.8 |
| 5,682,613 | 11/1997 | Dinatale | 2/168 |
| 5,770,297 | 6/1998 | Grubich | 428/99 |
| 5,780,112 | 7/1998 | Pugh et al. | 427/393.3 |
| 5,782,516 | 7/1998 | Partida | 294/25 |
| 5,792,531 | 8/1998 | Littleton et al. | 428/36.8 |
| 5,872,173 | 2/1999 | Anand | 524/494 |

*Primary Examiner*—John J. Calvert
*Assistant Examiner*—Katherine M. Moran
*Attorney, Agent, or Firm*—Andrea L. Wayda

[57] ABSTRACT

A thin elastomeric glove with enhanced gripping surfaces molded into the gripping surfaces of the glove is described. Preferably, the enhanced gripping surface is molded into each of the finger and thumb tips and body portions of the gloves. The enhanced gripping surface may be comprised of a plurality of concave indentations molded into the gripping surfaces of the glove. Alternatively, the enhanced gripping surface is comprised of a plurality of suction cups molded into the gripping surfaces of the glove. The glove may be constructed of any natural or synthetic rubber latex or blends or combinations thereof and has a thickness between about 0.004 to about 0.012 inches, an elongation greater than about 200%, a tensile strength between about 1500 to about 5000 psi and a 500% modulus between about 300 to about 2000 psi.

18 Claims, 4 Drawing Sheets

FIG. 2
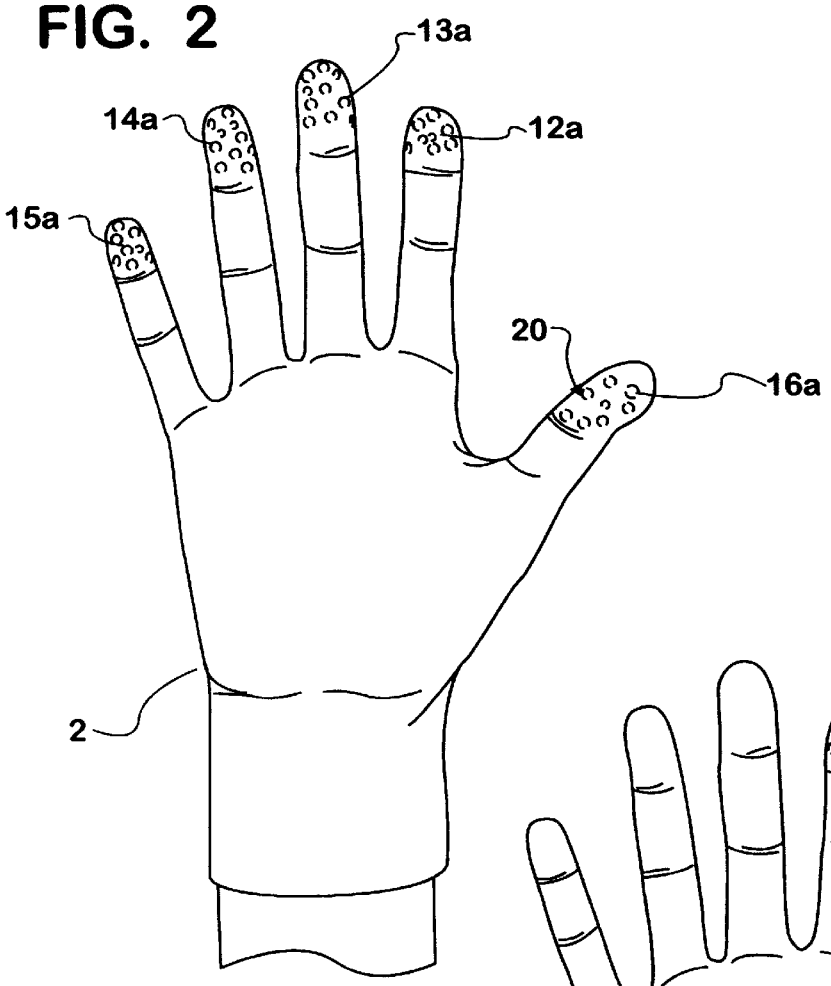
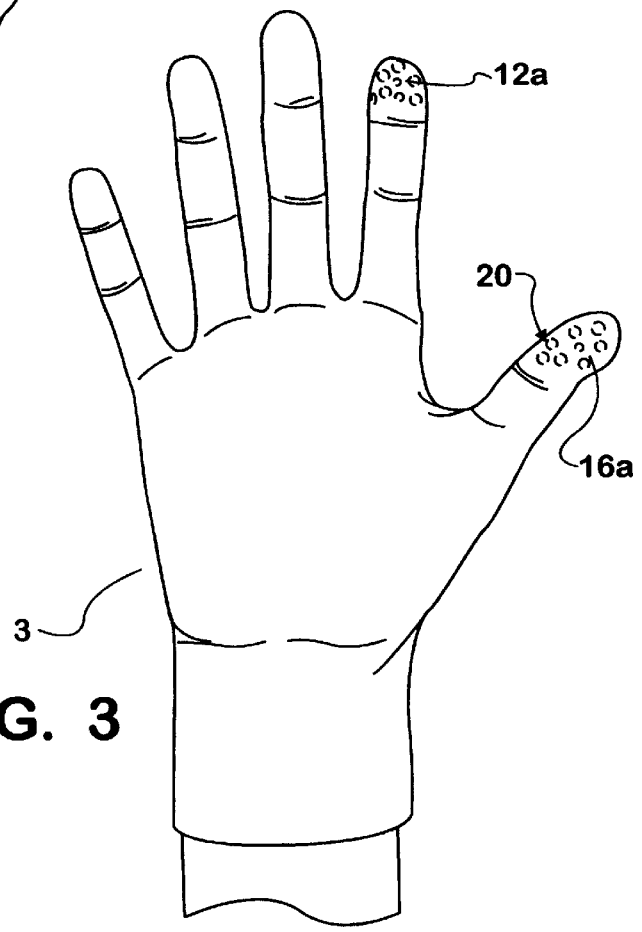
FIG. 3

ELASTOMERIC GLOVE WITH ENHANCED GRIP STRENGTH

BACKGROUND OF THE INVENTION

The present invention relates to an elastomeric glove with enhanced grip strength.

Surgical, medical and industrial elastomeric gloves are typically manufactured with a smooth external finish or micro-texture so that the glove user experiences a sensitive feel and hand-like touch while wearing the glove. However, it has been found that when such gloves get wet, there can be a decrease in grip strength One approach used to increase the grip strength of surgical, medical and industrial elastomeric gloves has focused on surface treatment using a variety of chemicals (e.g., acid, tackifier). In particular, gloves have been treated with acid to surface etch the glove and tackify the grip. Although somewhat effective in increasing the grip strength of surgical, medical and industrial elastomeric gloves, acid treatment has several disadvantages. For example, acid treatment necessitates the disposal of environmentally harmful acid wastes which must be discarded. In addition, costly secondary processing steps are needed for the acid treatment, and the physical and mechanical properties of the gloves are potentially degraded by the acid used to etch the glove surface.

A second approach to increasing grip strength has centered on using textured molds to form a visually bumpy, positive-textured surface on the glove. Although this technique may improve the grip of the molded glove, the surface bumps may, in fact, reduce the surface area of the glove available for gripping an object. This decrease in surface area could ultimately negatively effect the gripping strength of a glove molded with a positive textured surface.

SUMMARY OF THE INVENTION

In accordance with the invention, a thin elastomeric glove comprising a palm section, an index finger tip and body portion, a second finger tip and body portion, a ring finger tip and body portion, a fourth finger tip and body portion and a thumb tip and body portion is provided with increased surface area in the form of areas of suction on each of the gripping surfaces of the glove. Alternatively, only selected gripping surfaces of the glove may be provided with areas of suction. These areas of suction enhance the grip strength of the glove. In one embodiment of the invention, the glove has an outer surface for coming into contact with an object to be held which is comprised of a plurality of concave indentations which form a negative textured gripping surface. The concave indentations define a plurality of continuous planar contact surfaces and a plurality of suction portions on the outer surface of the glove. The concave indentations may be a single size and depth or various sizes and depths and are molded into the glove wherever additional grip is needed.

In another embodiment of the invention, the glove has an outer surface for coming into contact with an object to be held which is comprised of a plurality of suction cups which form a suction cup gripping surface. The suction cups define a plurality of suction portions on the outer surface of the glove. The suction cups may be a single size and depth or various sizes and depths and are molded into the surface of the glove wherever additional grip is desired.

The gloves of the invention have superior grip strength as compared to typical smooth-surfaced gloves. The increased grip strength of the gloves of the invention also allows them to be used in demanding environments which require a gripping surface with increased surface area. Such environments include, but are not limited to, computer chip assembly lines.

The gloves of the invention are also superior to the positively textured gloves designed to improve grip strength because they provide increased grip strength without affecting the tactile feel of the glove.

The method of manufacture of the gloves of the invention also has several advantages over other methods which have been used to manufacture gloves with increased grip strength. The gloves of the invention can be manufactured using conventional glove dipping technology and processing lines, injection molding, or other thin-walled plastic forming technologies (e.g., thermoforming, blow molding). To manufacture gloves of the invention having a gripping surface comprised of a plurality of concave indentations, the glove formers are provided with a surface comprised of a plurality of convex protrusions in those areas where improved grip strength is desired. The formers used to prepare these gloves have improved cleanability over the glove formers with concave indentations that are used to prepare positively textured gloves. The latter formers are difficult to clean with present glove cleaning techniques because latex or other materials readily accumulate in the concave surfaces The method used to manufacture the gloves of the invention is also easier to control than chemical methods for providing gloves with increased grip strength. This is because the glove former directly transfers the concave structure or the suction cup structure to the surface of the dipped glove. In contrast, chemical treatment such as acid dipping is difficult to control and can result in irregularly textured or treated surfaces.

BRIEF DESCRIPTION OF THE DRAWINGS

FIG. 2 is a perspective view of the palm side of a glove with improved grip strength in the finger tips and thumb tip according to the invention.

FIG. 3 is a perspective view of the palm side of a glove with improved grip strength in the index finger tip and thumb tip according to the invention.

DETAILED DESCRIPTION OF THE PREFERRED EMBODIMENTS

Figure 1:
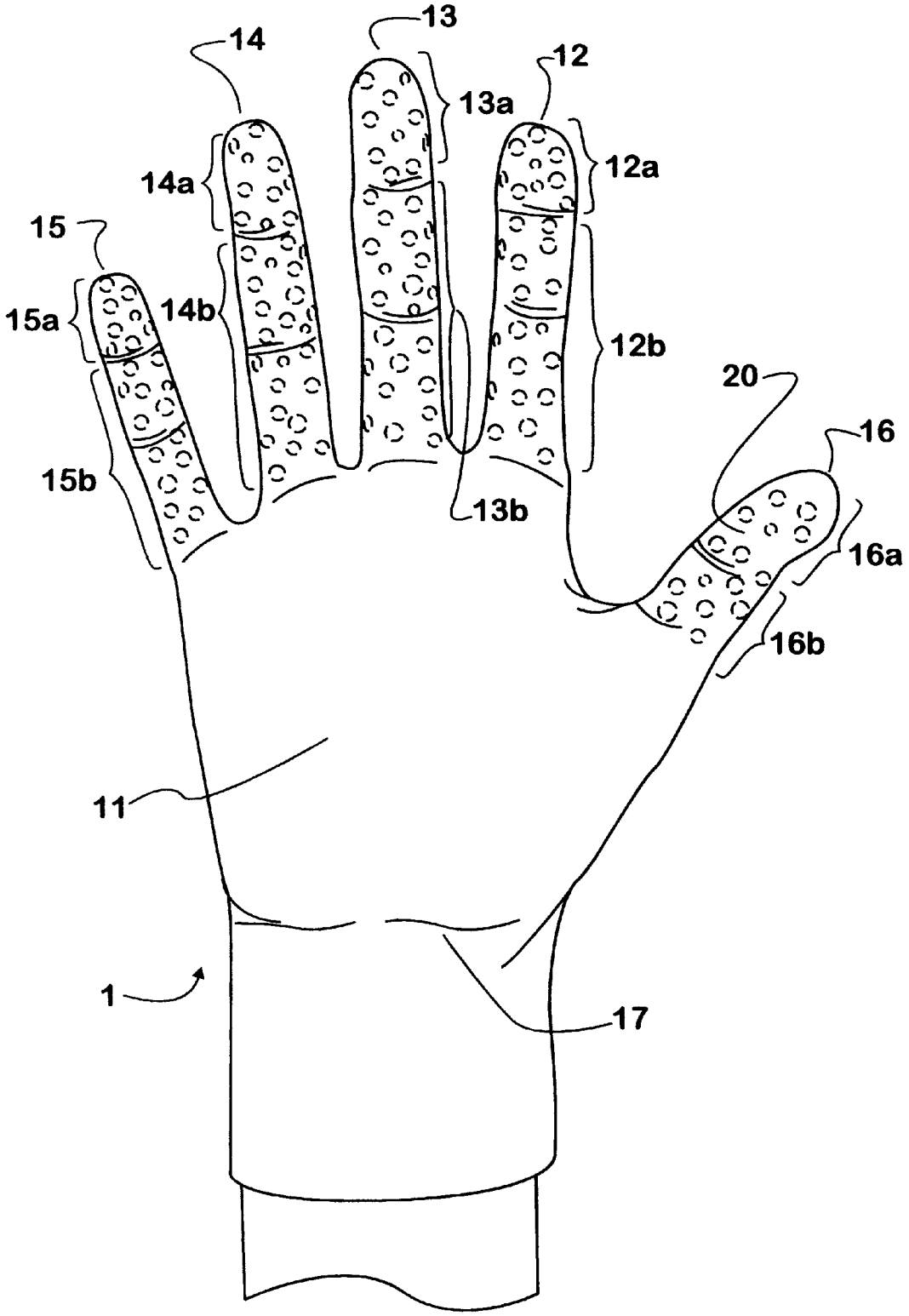
FIG. 1 is a perspective view of the palm side of a glove with improved grip strength in the finger tips and body portions and thumb tip and body portion according to the invention.

Referring to FIG. 1, a surgical, medical or industrial glove with enhanced grip strength 1 of the present invention comprises a palm section 11, an index finger 12, a second finger 13, a ring finger 14, a fourth finger 15 and a thumb 16 wherein each finger and thumb has a tip and a body portion designated by the letters a and b respectively appended to the reference numeral. For example, index finger 12 has a tip 12*a* and a body 12*b*. Palm section 11 extends from approximately the bottom of body portions 12*b*, 13*b*, 14*b* and 15*b* of fingers 12, 13, 14 and 15 and the bottom of body portion 16*b* of thumb 16 to heel area 17 of glove 1. An enhanced gripping surface 20 designed to improve grip strength is molded into the external surface of one or more of the fingers or thumb of the glove.

FIG. 1 illustrates a preferred embodiment of the glove of the invention 1 where an enhanced gripping surface 20 is molded into the each of the tips and body portions of the fingers 12, 13, 14 and 15 and thumb 16. FIG. 2 illustrates a preferred embodiment of the glove of the invention 2 where an enhanced gripping surface 20 is molded into each of the finger tips 12*a*, 13*a*, 14*a* and 15*a* and thumb tip 16*a*. FIG. 3 illustrates a preferred embodiment of the invention 3 where an enhanced gripping surface 20 is molded into the index finger tip 12*a* and the thumb tip 16*a*.

Figure 4:
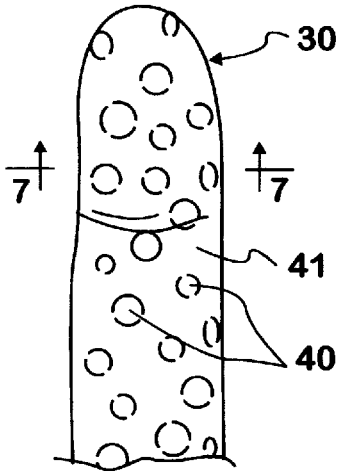
FIG. 4 is a perspective view of one of the fingers of a glove according to the invention illustrating a negative textured gripping surface comprised of concave indentations on the glove finger surface.
Figure 7:
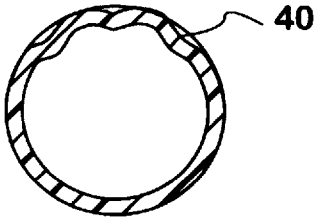
FIG. 7 is a cross-sectional view of FIG. 4 along line 7—7 illustrating the concave indentations in the external negatively textured glove finger surface.

Referring to FIG. 4, a glove of the invention is provided with a negative textured gripping surface 30 comprised of a plurality of concave indentations 40 on the outer gripping surface of a finger of the glove. A cross-sectional view of the negative textured gripping surface 30 and the concave indentations 40 is shown in FIG. 7. The concave indentations 40 may have a regularly shaped circular border with a diameter of between about 0.008 inches to about 0.5 inches. The concave indentations 40 may also have an elliptical border with a major axis between about 0.008 inches to about 0.5 inches and a minor axis between about 0.008 inches to about 0.5 inches. Alternatively, the concave indentations 40 may be irregularly shaped with the area of each indentation ranging between about $5\times10^{-5}$ $in^2$ to about 0.2 $in^2$. Preferably, the concave indentations 40 are circular with a diameter between about 0.07 to about 0.08 inches.

Figure 5:
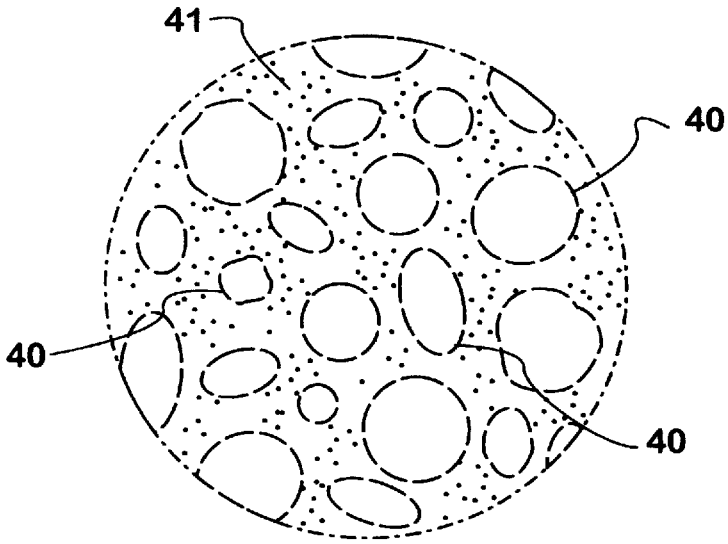
FIG. 5 is a perspective view of one of the fingers of a glove according to the invention illustrating the variety of shapes that the concave indentations of the negative textured gripping surface may have.

The concave indentations 40 may all have the same shape (e.g., all of the concave indentations 40 on all of the gripping surfaces may be regularly shaped circles as illustrated in FIG. 4) or may be a mixture of differently sized and shaped concave indentations as illustrated in FIG. 5.

The depth of the concave indentations 40 is between about 0.004 inches to about 0.020 inches. Preferably, the depth is between about 0.005 to about 0.007 inches. The concave indentations 40 occupy between about 1% to about 50% of the total finger and thumb surface gripping area, preferably between about 1% to 15%, most preferably between about 3% to about 5%.

The concave indentations 40 define a plurality of continuous planar contact surfaces 41 and a plurality of suction portions on the outer surface of the glove as illustrated in FIG. 5. The width between the borders of the concave indentations 40 preferably is between about 0.008 inches to about 1 inch. The depth, density, and pattern of the concave indentations 40 of the glove may be uniform or variable and will be determined by the elastomer used to form the glove, the environment in which the glove is intended for use, the processing techniques used to prepare the glove and other factors which effect grip properties which are well known to those in the glove art.

The negative textured gripping surface 30 may be molded into each of the tips and body portions of fingers 12, 13, 14 and 15 and thumb 16 as illustrated in the preferred embodiment of the glove 1 in FIG. 1. In another embodiment of the invention 2, the negative textured gripping surface 30 may be molded into the finger tips 12*a*, 13*a*, 14*a* and 15*a* and thumb tip 16*a* as illustrated in FIG. 2. In another embodiment of the invention 3, the negative textured gripping surface may be molded into the index finger tip 12*a* and the thumb tip 16*a* as illustrated in FIG. 3. Alternatively, the negative textured gripping surface 30 may be molded into any single external surface of any single tip or body portion or any combination thereof. If desired, the negative textured gripping surface 30 may also be molded into the palm section 11.

Figure 6:
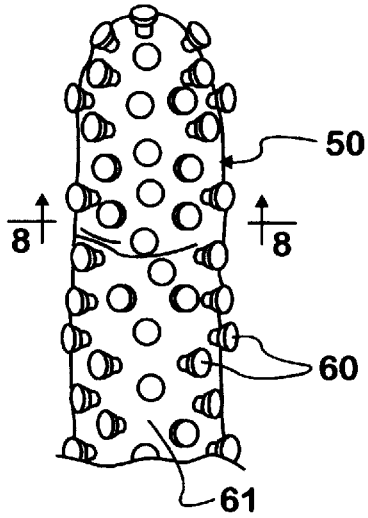
FIG. 6 is a perspective view of one of the fingers of a glove according to the invention illustrating a suction cup gripping surface comprised of suction cups molded into the external glove surface.
Figure 8:
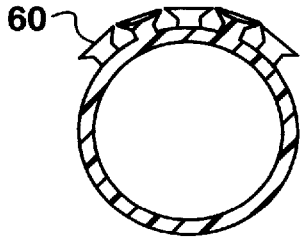
FIG. 8 is a cross-sectional view of FIG. 6 along line 8—8 illustrating the suction cups molded into the external glove finger surface.

Referring to FIG. 6, an alternative embodiment of a glove of the invention is shown with a suction cup gripping surface 50 comprised of a plurality of suction cups 60 integral with the outer gripping surface of a finger of the glove. A cross-sectional view of the suction cup gripping surface 50 and the integral suction cups 60 is shown in FIG. 8. Preferably, the suction cups 60 are molded right onto the outer glove surface.

The suction cup gripping surface 50 may be confined to the finger and thumb areas of the glove as illustrated in FIGS. 1, 2 and 3 or can be molded into any surface of the glove where improved grip strength is needed including the palm section 11.

Suction cups 60 may have a regularly shaped circular border with a diameter between about 0.008 inches to about 0.5 inches or may have an elliptical border with a major axis between about 0.008 inches to about 0.5 inches and a minor axis between about 0.008 inches to about 0.5 inches. Alternatively, the suction cups 60 may be irregularly shaped with the area of each cup ranging between about $5\times10^{-5}$ $in^2$ to about 0.2 $in^2$. The suction cups 60 may all have the same size and shape or may be a mixture of differently sized and shaped suction cups The depth of the suction cups 60 is between about 0.004 inches to about 0.020 inches. Preferably, the depth is between about 0.005 to about 0.007 inches. The height of the suction cups 60 is between about 0.0 inches to about 0.2 inches, preferably between about 0.0 inches to about 0.04 inches. The suction cups 60 occupy between about 1% to about 50% of the total finger and thumb surface gripping area, preferably between about 1% to about 15%, most preferably between about 3% to about 5%.

The suction cups 60 define a plurality of suction portions on the outer surface of the glove as illustrated in FIG. 6. The width between the borders of the suction cups 60 preferably is between about 0.008 inches to about 1 inch.

The density and pattern of the suction cups 60 in the suction cup gripping surface 50 may be uniform or variable and will be determined by the elastomer used to form the glove, the environment in which the glove is intended for use, the processing techniques used to prepare the glove and other factors which effect grip properties which are well known to those in the glove art.

Figure 9:
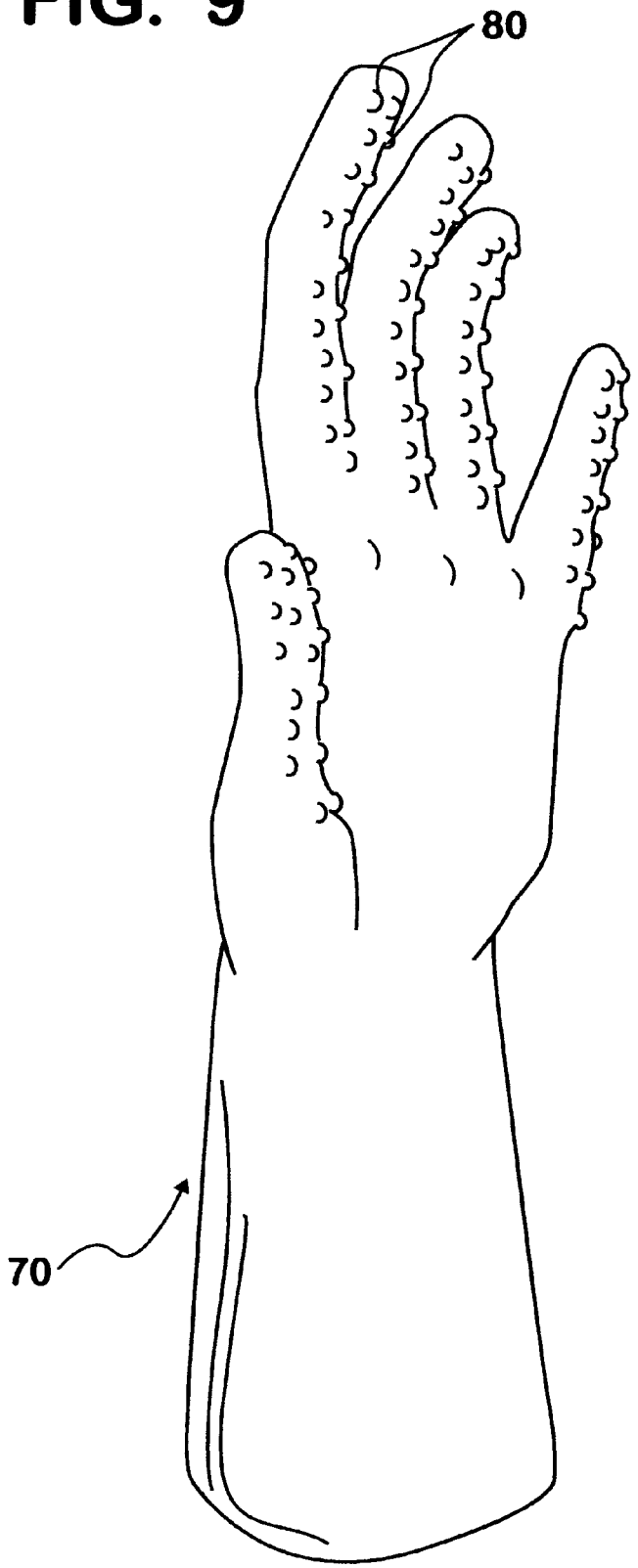
FIG. 9 is a perspective view of a glove former with convex protrusions used to form a glove of the type illustrated in FIG. 1.

The gloves of the invention can be manufactured using conventional dipping technology or other elastomer processing technologies such as injection molding using glove formers or molds which have on their surface the image of the particular structure that is to be transferred to the dipped or molded glove. FIG. 9 illustrates a glove former 70 with convex protrusions 80 used to form a glove of the type illustrated in FIG. 1

The gloves of the invention are thin, preferably between about 0.004 to about 0.012 inches thick, more preferrably between about 0.005 to about 0.008 inches thick and most preferrably between about 0.007 to about 0.008 inches thick and can be made of any elastomeric material that exhibits elongation greater than about 200%, preferably greater than about 500%. The gloves of the invention have a tensile strength between about 1500 to about 5000 psi and a 500% modulus between about 300 to about 2000 psi. Preferably, the gloves of the invention have a tensile strength between about 2000 to about 5000 psi and a 500% modulus between about 300 to about 1500 psi.

Suitable elastomeric materials include, but are not limited to, natural rubber latex, nitrile rubber, polychloroprene, polyurethane, thermoplastic elastomers, synthetic polyisoprene, styrene block copolymers, and other synthetic elastomers and blends of the above. Preferably, the elastomeric material is nitrile rubber. The dipping and injection molding formulations used to produce the subject gloves are not limited to the base elastomer or blend and may contain common compounding ingredients such as cross-linkers, accelerators, stabilizers, colorants and vulcanizing agents. The dipping formulations may also include emulsifiers. The specific compounding ingredients chosen for the gloves will vary with the elastomer and the glove application.

The gloves of the invention may be powdered on their internal surface to improve donnability or may be powder-free. Additionally, the gloves of the invention may be provided with an internal coating to improve donnability as described in U.S. Pat. Nos. 3,411,982 and 4,482,577 which are hereby incorporated by reference in their entirety. The gloves of the invention may also be chlorinated to improve donnability as set forth in U.S. Pat. Nos. 3,740,262 and 3,992,221 which are hereby incorporated by reference in their entirety. The gloves of the invention may also be provided with an external coating as set forth in U.S. Pat. Nos. 4,310,928 and 5,069,965 which are hereby incorporated by reference in their entirety.

The invention is illustrated by the following Example.

EXAMPLE 1

A powder-free nitrile rubber glove with a plurality of concave indentations in the finger and thumb tips and body portions is manufactured as set forth below.

A glove former with a plurality of convex protrusions in the finger and thumb tips and body portions is preheated in an oven. The glove former is then dipped into a coagulation bath. After withdrawing the former from the bath, the former with the coagulant deposited on it is dried in an oven. The glove former bearing the dried coagulant layer is then dipped into a compounded nitrile rubber latex formulation. The glove former bearing the coagulated nitrile rubber latex film is then removed from the formulation bath and again dried in an oven. The nitrile rubber latex film is then leached in a hot water bath. The glove former bearing the nitrile rubber latex film is then dipped into a powder slurry or a polymer coating bath. The glove former is then withdrawn from the bath and the composite nitrile rubber latex film deposited on the former is cured in an oven. The glove is then stripped from the former.

To prepare a powder-free glove of the invention, the glove is post-processed by chlorination or other treatment process to remove the powder.

The tensile strength, stress at 500% modulus and elongation to break of the subject gloves are measured according to ASTM D412-92.

While the invention has been illustrated and described in detail in the drawings and foregoing description, the same is to be considered illustrative and not restrictive in character. All changes and modifications that come within the spirit of the invention are contemplated as within the scope of the invention.

What is claimed is:

1. A thin elastomeric glove having an outer surface for coming into contact with an object to be held said surface comprised of a plurality of planar contact areas and a plurality of suction areas wherein the suction area is comprised of a plurality of concave indentations and wherein the glove is comprised of nitrile rubber and wherein the thickness of the glove is between about 0.004 to about 0.012 inches.

2. The glove of claim 1 wherein the glove is powder-free.

3. The glove of claim 2 wherein the thickness of the glove is between about 0.005 to about 0.008 inches.

4. The glove of claim 3 wherein the elongation of the glove is greater than about 200%.

5. The glove of claim 4 wherein the tensile strength of the glove is between about 1500 to about 5000 psi.

6. A thin elastomeric glove having an outer surface for coming into contact with an object to be held said surface comprised of a plurality of planar contact areas and a plurality of suction areas wherein the suction area is comprised of a plurality of concave indentations and wherein the outer surface for coming into contact with an object to be held is confined to the finger tips and finger body portions and thumb tip and thumb body portion of said glove.

7. The glove of claim 6 wherein the glove is comprised of nitrile rubber.

8. The glove of claim 7 wherein the glove id powder-free.

9. The glove of claim 8 wherein the thickness of the glove is between about 0.004 to about 0.012 inches.

10. The glove of claim 9 wherein the elongation of the glove is greater than about 200%.

11. The glove of claim 10 wherein the tensile strength of the glove is between about 1500 to about 5000 psi.

12. A thin elastomeric glove having an outer surface for coming into contact with an object to be held said surface comprised of a plurality of planar contact areas and a plurality of suction areas wherein the suction area is comprised of a plurality of concave indentations and wherein the outer surface for coming into contact with an object to be held is confined to the index finger tip and thumb tip of said glove.

13. The glove of claim 12 wherein the glove is comprised of nitrile rubber.

14. The glove of claim 13 wherein the glove is powder-free.

15. The glove of claim 14 wherein the thickness of the glove is between about 0.004 to about 0.012 inches.

16. The glove of claim 15 wherein the elongation of the glove is greater than about 00%.

17. The glove of claim 16 wherein the tensile strength of the glove is between about 1500 to about 5000 psi.

18. A thin elastomeric glove with a thickness between about 0.004 to about 0.012 inches comprised of nitrile rubber having an outer surface for coming into contact with an object to be held said surface comprised of a plurality of suction cups.

* * * * *